US005608364A

United States Patent [19]

Hirai et al.

[11] Patent Number: 5,608,364

[45] Date of Patent: Mar. 4, 1997

[54] LAYERED STRIPLINE FILTER INCLUDING INDUCTIVE COUPLING ADJUSTMENT STRIP

[75] Inventors: Takami Hirai, Nishikamo-gun; Masahiko Watanabe, Nagoya, both of Japan

[73] Assignees: NGK Insulators, Ltd., Nagoya; Soshin Electric Co., Ltd., Tokyo, both of Japan

[21] Appl. No.: 332,390

[22] Filed: Oct. 31, 1994

[30] Foreign Application Priority Data

Nov. 2, 1993 [JP] Japan ..... 5-274633

[51] Int. Cl.[6] ..... H01P 1/20

[52] U.S. Cl. ..... 333/204; 333/185; 333/219

[58] Field of Search ..... 333/202, 203, 333/204, 185, 219, 246

[56] References Cited

U.S. PATENT DOCUMENTS 5,034,709 7/1991 Azumi et al. ..... 333/185
5,066,934 11/1991 Ito et al. ..... 333/204
5,192,926 3/1993 Sogo et al. ..... 333/204

FOREIGN PATENT DOCUMENTS 5152803 6/1993 Japan ..... 333/204
6120703 4/1994 Japan ..... 333/204
6152202 5/1994 Japan ..... 333/204

*Primary Examiner*—Benny Y. Lee
*Assistant Examiner*—Darius Gambino
*Attorney, Agent, or Firm*—Ronald J. Kubovcik

[57] ABSTRACT

A layered stripline filter has input and output electrodes formed on a dielectric layer, two resonant elements disposed on the dielectric layer and having ends connected to a ground electrode, providing a quarter-wave stripline resonator, an inductive coupling adjustment electrode disposed on the dielectric layer intermediate between the two resonant elements and having opposite ends connected to the ground electrode, and a coupling electrode disposed on the dielectric layer in overlapping relationship to portions of the two resonant elements. The layered stripline filter is small in size and has a desired bandwidth achieved by adjusting the inductive coupling between the two resonant elements. The layered stripline filter has an attenuation peak spaced from the passband thereof, resulting improved attenuation and spurious characteristics.

2 Claims, 8 Drawing Sheets

LAYERED STRIPLINE FILTER INCLUDING INDUCTIVE COUPLING ADJUSTMENT STRIP

BACKGROUND OF THE INVENTION

1. Field of the Invention

The present invention relates to a layered stripline filter, and more particularly to a layered stripline filter for use as a high-frequency circuit filter in a high-frequency radio communication device such as a portable telephone set or the like, or in an antenna duplexer, or the like.

2. Description of the Prior Art

FIGS. 1 and 2 of the accompanying drawings show, respectively in exploded perspective and perspective, a conventional layered stripline filter devised by the inventors of the present application.

As shown in FIG. 1, the layered stripline filter has a dielectric layer 11, a dielectric layer 13 disposed on the dielectric layer 11 and supporting an output electrode 42 thereon, and a dielectric layer 14 which is placed on the dielectric layer 13 and supports thereon a plurality of resonant elements 21, 22, 23 each composed of a quarter-wave stripline resonator, the resonant elements 21, 22, 23 having ends connected to a ground electrode 70 (see FIG. 2), the output electrode 42 underlying a portion of the resonant element 23 on an output terminal side across the dielectric layer 14. The dielectric layer 14 also supports thereon a plurality of electrodes 31, 32, 33 having ends connected to the ground electrode 70 and opposite ends spaced predetermined distances from the open ends of the resonant elements 21, 22, 23, respectively, in confronting relationship thereto. The layered stripline filter also includes a dielectric layer 15 positioned on the dielectric layer 14 and supporting thereon an input electrode 41 which is positioned in overlapping relationship to the resonant element 21 on an input terminal side across the dielectric layer 15, and a dielectric layer 17 placed on the dielectric layer 15, with the ground electrode 70 disposed on a surface of the dielectric layer 17. The dielectric layers 11, 13, 14, 15, 17 are integrally combined and then fired into a laminated assembly 500 (see FIG. 2).

As shown in FIG. 2, the ground electrode 70 is disposed on upper and lower surfaces of the laminated assembly 500 and side surfaces thereof except input and output terminal areas 61, 62. The input terminal area 61, which is positioned on one side surface of the laminated assembly 500, has an input terminal 51 that is insulated from the ground electrode 70 and connected to the input electrode 41. The output terminal area 62, which is positioned on an opposite side surface of the laminated assembly 500, has an output terminal 52 that is insulated from the ground electrode 70 and connected to the output electrode 42.

FIG. 3 of the accompanying drawings shows an equivalent electric circuit of the layered stripline filter shown in FIGS. 1 and 2. In FIG. 3, the equivalent electric circuit includes a capacitance 111 between the resonant element 21 and the input electrode 41, a capacitance 112 between the resonant element 23 and the output electrode 42, a capacitance 121 between the resonant element 21 and the electrode 31, a capacitance 122 between the resonant element 22 and the electrode 32, a capacitance 123 between the resonant element 23 and the electrode 33, an inductance 132 indicative of inductive coupling between the resonant elements 21, 22, and an inductance 133 indicative of inductive coupling between the resonant elements 22, 23. The equivalent electric circuit of such an arrangement serves as a bandpass filter. The equivalent electric circuit also includes parallel resonant circuits having respective capacitances 211, 221, 231 and respective inductances 212, 222, 232 which are equivalently converted from the respective resonant elements 21, 22, 23.

The electrodes 31, 32, 33 are disposed in confronting relationship to the open ends of the resonant elements 21, 22, 23, respectively. Therefore, the capacitances 121, 122, 123 are formed between the open ends of the resonant elements 21, 22, 23 and the electrodes 31, 32, 33. These capacitances 121, 122, 123 are added respectively to the capacitances 211, 221, 231 as equivalently converted from the respective resonant elements 21, 22, 23. If the parallel resonant circuits have the same resonant frequency, then the inductances of the parallel resonant circuits may be smaller, the resonant elements 21, 22, 23 may be shorter, and hence the overall length of the layered stripline filter may be reduced.

If the electrical length of the resonant elements is reduced to reduce the size of the layered stripline filter, however, the resonant elements are coupled by stronger inductive coupling, resulting in a filter bandwidth that is too wide. Consequently, it is not possible to achieve a layered stripline filter having a desired bandwidth.

With the layered stripline filter of the above structure, the electromagnetic fields of the resonant elements 21, 22, 23 are disturbed at short-circuited portions thereof, tending to intensify the inductive coupling thereof. Accordingly, the bandwidth of the layered stripline filter is undesirably increased by the strong inductive coupling between the resonant elements.

SUMMARY OF THE INVENTION

It is therefore an object of the present invention to provide a layered stripline filter which is small in size and has a desired bandwidth achieved by adjusting the inductive coupling between resonant elements.

According to the present invention, there is provided a layered stripline filter comprising a first ground electrode, a second ground electrode, a dielectric layer disposed between the first ground electrode and the second ground electrode, a first resonant element short-circuited at one side and disposed in the dielectric layer, a second resonant element short-circuited at one side and disposed adjacent to the first resonant element in the dielectric layer, a first electrode disposed in the dielectric layer in confronting relationship to a portion of the first resonant element and a portion of the second resonant element, and a second electrode disposed in the dielectric layer between the first resonant element and the second resonant element.

Preferably, the second electrode has opposite ends short-circuited to ground.

More preferably, the second electrode has opposite ends short-circuited to ground, and is disposed in the dielectric layer in confronting relationship to a portion of the first electrode.

The first and second resonant elements which are short-circuited at one side are positioned adjacent to each other, and the first electrode is disposed in confronting relationship to portions of the first and second resonant elements. Capacitances are formed between the first electrode and the first and second resonant elements, and a combination of these capacitances is connected parallel to an inductive coupling formed between the first and second resonant elements. The capacitances are effective in suppressing the inductive coupling formed between the first and second resonant elements. By adjusting the values of these capacitances, it is possible to adjust the degree of inductive coupling between the first and second resonant elements. Therefore, there is obtained a filter having a desired bandwidth. The values of the capacitances can easily be adjusted by varying the overlapping areas of and the distance between the first resonant element and the first electrode and the overlapping areas of and the distance between the second resonant element and the first electrode.

Since the first electrode is disposed in confronting relationship to the first and second resonant elements, a combination of the capacitances formed between the first and second resonant elements and the first electrode is connected parallel to an inductive coupling formed between the first and second resonant elements. Therefore, a parallel resonant circuit composed of the capacitances and an inductance is inserted between the first and second resonant elements that are adjacent to each other. As the impedance of the parallel resonant circuit composed of the capacitances and the inductance varies from an inductive nature to a capacitive nature across the parallel resonance, the coupling between the resonant elements may be made inductive or capacitive by adjusting the values of the capacitances formed between the resonant elements and the first electrode. If the coupling between the resonant elements is made inductive, then the filter has an attenuation peak in a frequency range higher than the passband because the parallel resonance is present in the higher frequency range. If the coupling between the resonant elements is made capacitive, then the filter has an attenuation peak in a frequency range lower than the passband because the parallel resonance is present in the lower frequency range. At any rate, the attenuation characteristics of the filter are improved.

The second electrode is disposed in the dielectric layer between the first and second resonant elements. The second electrode serves to weaken the inductive coupling between the first and second resonant elements. The inductive coupling between the first and second resonant elements may be weakened by increasing the distance between the first and second resonant elements. The increased distance between the first and second resonant elements is not preferable because it increases the size of the layered stripline filter, which then fails to meet a demand for small-size layered stripline filters.

With the present invention, as described above, not only the first electrode is disposed in confronting relationship to portions of the first and second resonant elements which are disposed adjacent to each other, but also the second electrode is disposed in the dielectric layer between the first and second resonant elements. Therefore, a parallel resonant circuit composed of capacitances and an inductance is inserted between the first and second resonant elements. The coupling between the first and second resonant elements can be adjusted by the capacitances, and the strength of the inductive coupling itself between the first and second resonant elements can also be adjusted. As a consequence, the bandwidth of the filter and the position of the attenuation peak can individually be varied to achieve desired filter characteristics with ease.

The bandwidth of a filter is determined by the magnitude of the absolute value of the admittance of a coupling circuit between first and second resonant elements at the center frequency of the filter. Since the first electrode is disposed in confronting relationship to portions of the first and second resonant elements, a parallel resonant circuit composed of capacitances and an inductance is inserted between the first and second resonant elements. Consequently, the coupling circuit between the first and second resonant elements comprises such a parallel resonant circuit composed of capacitances and an inductance, and the admittance jY thereof is expressed by:

$$jY=j(\omega C-1/\omega L) \tag{1}$$

where C is the coupling capacitance between the first and second resonant elements, and L is the inductance as equivalently converted from the inductive coupling between the first and second resonant elements.

If capacitances are connected to open ends of the first and second resonant elements, then the lengths of the first and second resonant elements are reduced. If, as a result, the inductive coupling due to a distributed coupling between the first and second resonant elements is increased, i.e., the inductance L is reduced, the admittance jY between the first and second resonant elements can be set to a desired value by increasing the coupling capacitance C correspondingly. Consequently, it is possible to set the degree of coupling between the first and second resonant elements to a desired value.

Even if the inductive coupling of the coupling circuit is increased, as described above, the degree of coupling between the first and second resonant elements can be adjusted by increasing the coupling capacitance of the coupling circuit, resulting in a filter having a desired bandwidth. When the inductive coupling of the coupling circuit is increased and the inductance L is reduced, the frequency at the attenuation peak of the filter produced by the parallel resonant circuit composed of capacitances and an inductance approaches the center frequency of the filter. As a result, the attenuation characteristics in a region (a region E in FIGS. 10 and 11 of the accompanying drawings) which is opposite to the attenuation peak across the passband are degraded.

More specifically, if the coupling between the first and second resonant elements is a capacitive coupling (Y>0), and the inductive coupling between the first and second resonant elements is made strong and the value of the inductance L is reduced to ½ in the case where the attenuation peak is in a frequency range lower than the passband, then a capacitance C' required to keep the width of the passband constant while the value of Y is being constant is represented by:

$$\omega C'=2\omega C-Y \tag{2}$$

and the parallel resonant frequency $\omega_p$ at this time is given as follows:

$$\omega_p = 1/\sqrt{L(C - Y/2\omega)} \quad . \tag{3}$$

Since Y>0, the parallel resonant frequency $\omega_p$ is higher than a parallel resonant frequency $\omega_0$, given below, before the strength of the inductive coupling between the first and second resonant elements is increased:

$$\omega_0 = 1/\sqrt{LC} \quad , \tag{4}$$

and approaches the center frequency of the passband of the filter.

If the coupling between the first and second resonant elements is an inductive coupling (Y<0), and the inductive coupling between the first and second resonant elements is made strong and the value of the inductance L is reduced to ½ in the case where the attenuation peak is in a frequency range higher than the passband, then a capacitance C' required to keep the width of the passband constant while the value of Y is being constant is represented by:

$$\omega C'=2\omega C-Y \quad (5),$$

and the parallel resonant frequency $\omega_p$ at this time is given as follows:

$$\omega_p = 1/\sqrt{L(C-Y/2\omega)} \quad (6)$$

Since Y<0, the parallel resonant frequency $\omega_p$ is lower than a parallel resonant frequency $\omega_0$, given below, before the strength of the inductive coupling between the first and second resonant elements is increased:

$$\omega_0 = 1/\sqrt{LC}, \quad (7)$$

and also approaches the center frequency of the passband of the filter.

A filter requires not only frequency characteristics in the vicinity of its passband, but also a certain attenuation in a frequency range spaced from the passband. Therefore, if the attenuation peak is too close to the center frequency of the passband, it may be difficult to provide a filter which meets given standards.

According to the present invention, since the second electrode is disposed in the dielectric layer between the first and second resonant elements, the inductive coupling itself between the first and second resonant elements can be reduced. As a result, the attenuation peak is spaced from the passband of the filter, and the attenuation in a region (a region E in FIGS. 10 and 11 of the accompanying drawings) which is opposite to the attenuation peak across the passband is increased. The filter thus has improved attenuation characteristics.

More specifically, the inductive coupling between adjacent resonant elements is determined by the characteristic impedance ($Z_{even}$) in an even mode of a stripline of the resonant elements, the characteristic impedance ($Z_{odd}$) in an odd mode of the stripline, and the coupling electrical length ($\theta$). If the inductance indicative of the inductive coupling is represented by $L_c$, then the reactance $\omega L_c$ is given by:

$$\omega L_c = Z_c \tan\theta \quad (8)$$

where $$1/Z_c = (1/Z_{odd} 1/Z_{even})/2 \quad (9).$$

As described above, in order to space the attenuation peak from the passband, the inductive coupling between the first and second resonant elements must be small, i.e., the inductance L=must be large. The inductance $L_c$ may be increased by either increasing the impedance $Z_c$ or the coupling electrical length $\theta$. If the coupling electrical length $\theta$ were increased, the length of the resonant elements would be increased, failing to meet requirements for a small-size filter. From the equation (9), it can be seen that the impedance $Z_c$ may be increased by reducing the difference between the impedance $Z_{even}$, $Z_{odd}$.

The even mode has an electromagnetic field distribution on the assumption that a magnetic wall is placed centrally between adjacent resonant elements. The odd mode has an electromagnetic field distribution on the assumption that an electric wall is placed centrally between adjacent resonant elements. As the characteristic impedance of a stripline serving as the resonant elements is determined by a capacitance between the stripline and a surrounding conductor, the difference between the two characteristic impedances, i.e., the difference between the impedance $Z_{even}$, $Z_{odd}$, is small if the difference between the electromagnetic field distributions of the even and odd modes is small.

In the even mode, the electromagnetic field distribution between the resonant elements is small since it is assumed that a magnetic wall is placed centrally between adjacent resonant elements. In the odd mode, since it is assumed that an electric wall is placed centrally between adjacent resonant elements, an electromagnetic field distribution is generated between the resonant elements through the electric wall. Therefore, the difference between the electromagnetic field distributions of the even and odd modes is large. If an electrode is positioned between the adjacent resonant elements, then because an electromagnetic field distribution is generated between the resonant elements through the electrode even in the even mode, the difference between the electromagnetic field distributions of the even and odd modes becomes small, and as a result, the difference between the impedance $Z_{even}$, $Z_{odd}$ becomes small. Consequently, the inductance $L_c$ is increased according to the equations (8), (9), and the inductive coupling between the adjacent resonant elements is reduced. With the inductive coupling reduced, the attenuation peak is spaced from the passband of the filter for producing an increased attenuation.

If the second electrode disposed between the first and second resonant elements has either its both ends open, or one end short-circuited to ground, or its both ends short-circuited to ground, then the inductive coupling between the first and second resonant elements can be reduced. However, the inductive coupling between the first and second resonant elements can be reduced particularly effectively by grounding both ends of the second electrode.

The spurious characteristics of the filter can be improved by short-circuiting to ground both ends of the second electrode disposed between the first and second resonant elements and positioning the second electrode in the dielectric layer in confronting relationship to a portion of the first electrode which confronts portions of the first and second elements.

More specifically, the second electrode whose opposite ends are short-circuited to ground has inductive electric characteristics if the electrical length thereof is equal to or less than one-half wavelength. With the second electrode disposed in the dielectric layer in confronting relationship to a portion of the first electrode, the second electrode and the first electrode are capacitively coupled to each other. As a result, a series resonant circuit composed of a capacitance and an inductance is added parallel to the filter circuit. An attenuation peak is produced at the resonant frequency of the series resonant circuit. As a result, it is possible to improve spurious characteristics of the filter.

The second electrode with its opposite ends or one end short-circuited has inductive electric characteristics if the electrical length thereof is equal to or less than one-quarter wavelength. Therefore, if the electrical length of the second electrode is equal to or less than one-quarter wavelength, irrespective of whether the opposite ends or one end thereof is short-circuited, a series resonant circuit composed of a capacitance and an inductance is added parallel to the filter circuit by positioning the second electrode in the dielectric layer in confronting relationship to a portion of the first electrode. Consequently, an attenuation peak is produced at the resonant frequency of the series resonant circuit, making it possible to improve spurious characteristics of the filter.

If the electrical length of the second electrode is equal to or less than one-quarter wavelength, an attenuation peak is produced irrespective of whether the opposite ends or one end thereof is short-circuited, and the frequency of the attenuation peak is close to the center frequency of the filter. However, if the electrical length of the second electrode is greater than one-quarter wavelength, but equal to or less than one-half wavelength, then an attenuation peak is produced when both ends of the second electrode are short-circuited to ground, but the frequency thereof is spaced from the center frequency of the filter, resulting in spurious characteristics in a wider range.

An attenuation peak can be generated at a desired frequency by adjusting the values of the capacitance and the inductance of the series resonant circuit and also adjusting the resonant frequency of the series resonant circuit. The inductance of the series resonant circuit can easily be adjusted by varying the width of the second electrode, and the capacitance thereof can also easily be adjusted by varying the overlapping areas of and the distance between the second and first electrodes.

The electrical length of the second electrode is defined as an electrical length thereof with respect to the wavelength at a frequency in question. If a certain attenuation peak is in question, then the electrical length of the second electrode is referred to as one-half wavelength or one-quarter wavelength with respect to the wavelength at a frequency at which the attenuation peak is produced.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
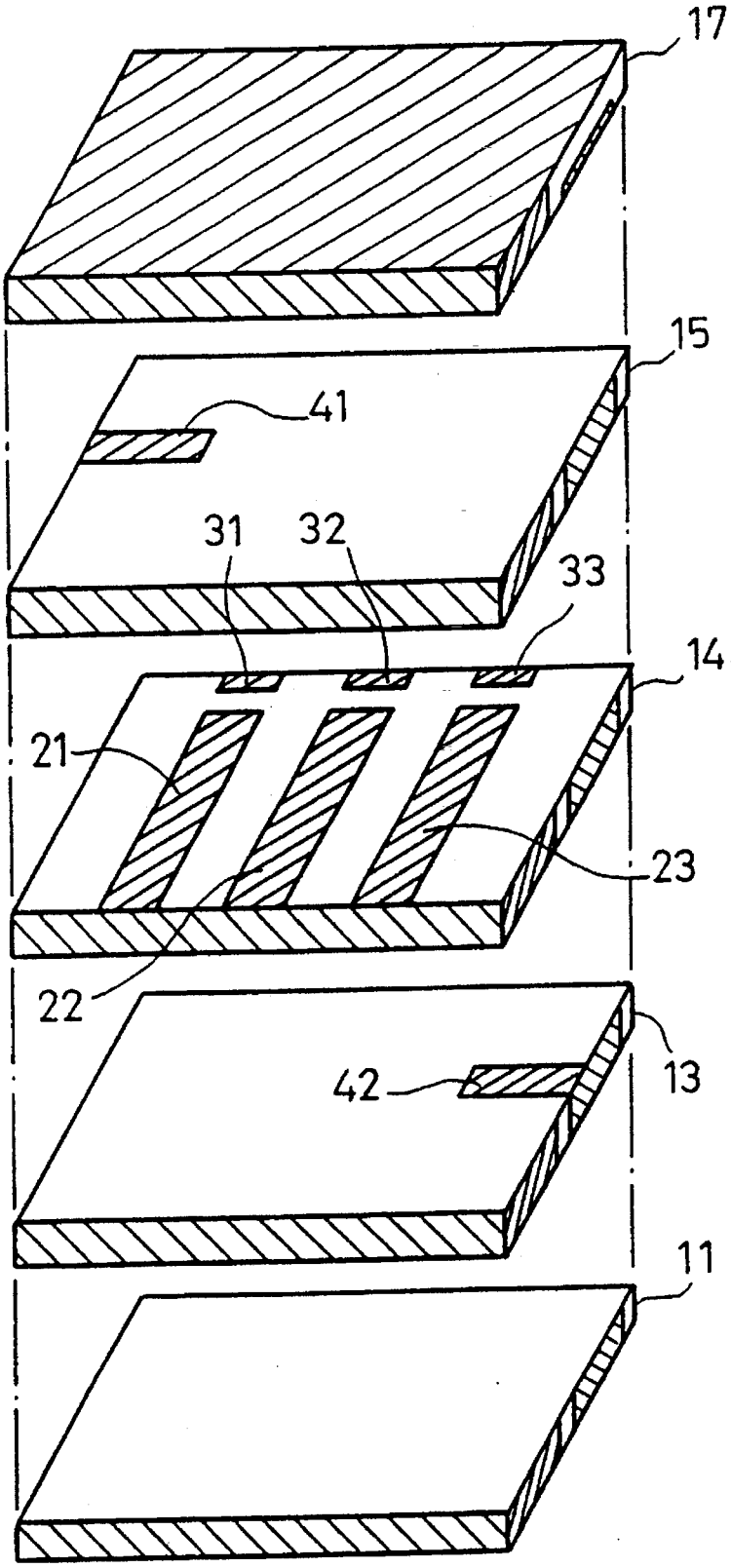
FIG.1 PRIOR ART
FIG. 1 is an exploded perspective view of a conventional layered stripline filter.
Figure 2:
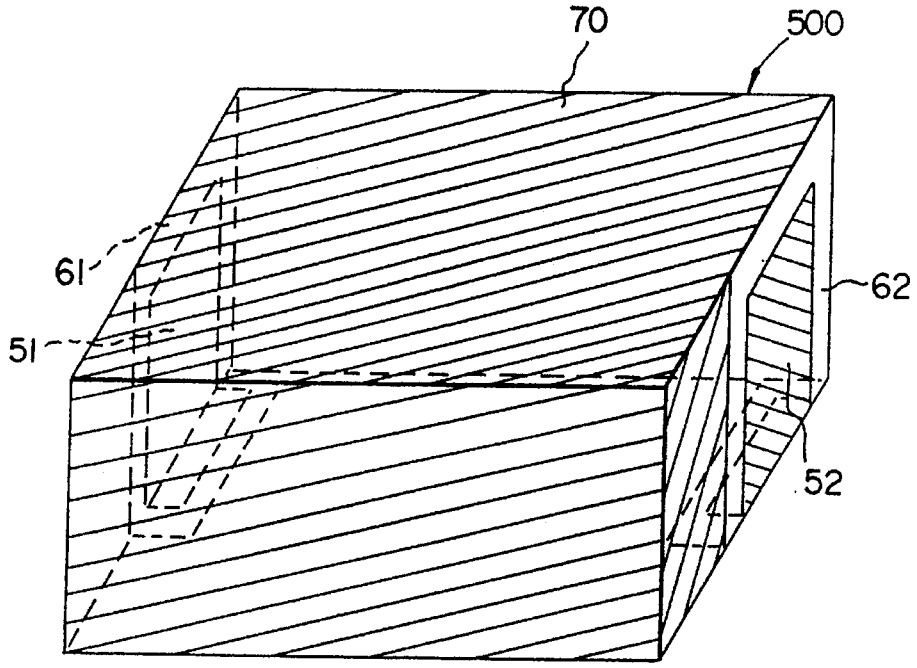
FIG. 2 PRIOR ART
FIG. 2 is a perspective view of the conventional layered stripline filter.
Figure 3:
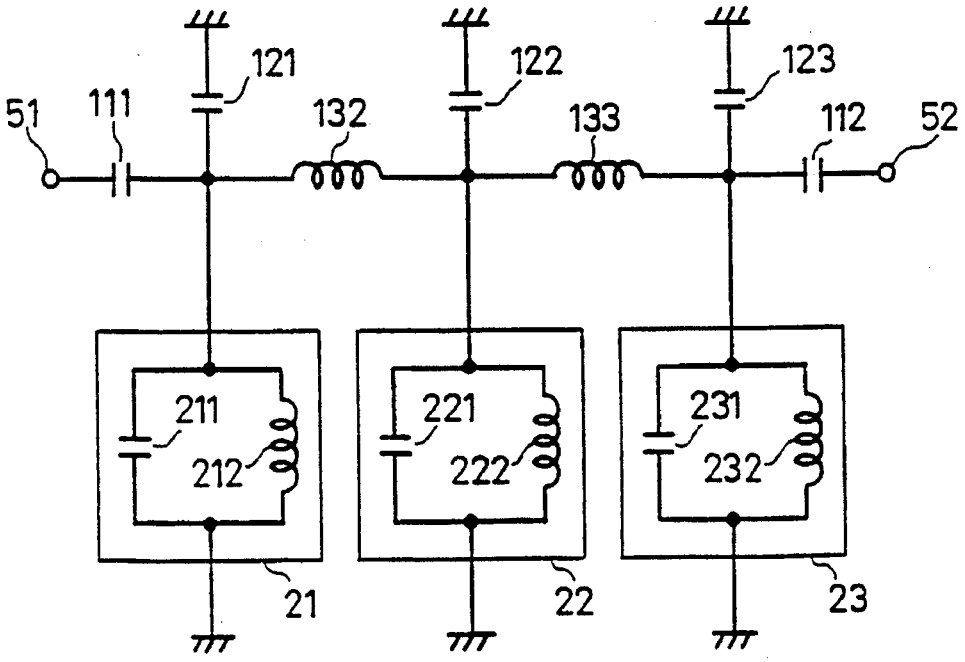
FIG. 3 PRIOR ART
FIG. 3 is a circuit diagram of an equivalent electric circuit of the conventional layered stripline filter.
Figure 4:
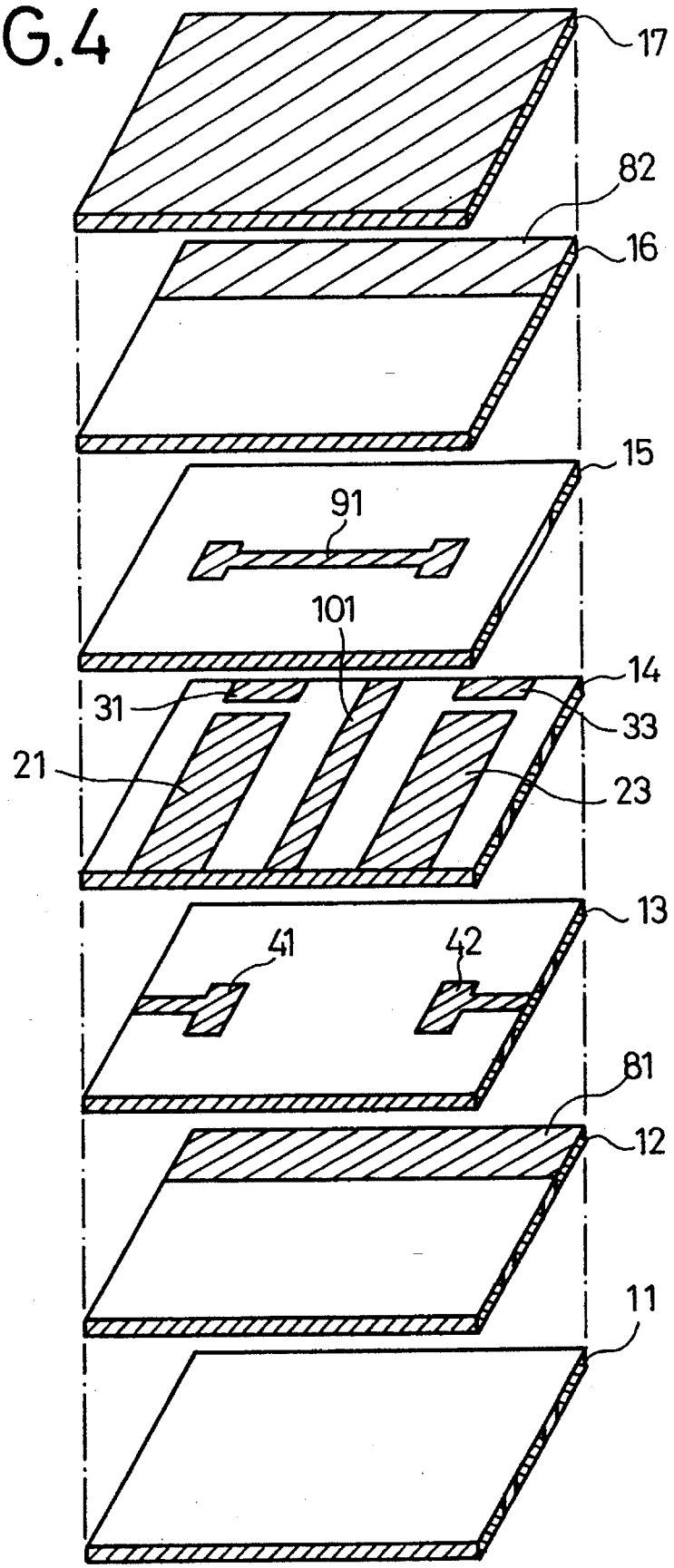
FIG. 4 is an exploded perspective view of a layered stripline filter according to the present invention.

As shown in FIG. 4, a layered stripline filter according to the present invention comprises a plurality of dielectric layers 11, 12, 13, 14, 15, 16, 17. The dielectric layer 12, which is placed on the dielectric layer 11, supports thereon an inner-layer ground electrode 81 having an end connected to a ground electrode 70 (see FIG. 2) and disposed in underlying relationship to open ends of resonant elements 21, 23 across the dielectric layers 13, 14.

The dielectric layer 13, which is placed on the dielectric layer 12, supports thereon a pair of input and output electrodes 41, 42. The input electrode 41 is disposed in underlying relationship to a portion of the resonant element 21 on an input terminal side, and the output electrode 42 is disposed in underlying relationship to a portion of the resonant element 23 on an output terminal side.

The resonant elements 21, 23 which have respective ends connected to the ground electrode 70 thus serving as a quarter-wave stripline resonator are disposed on the dielectric layer 14, which is placed on the dielectric layer 13, thereby making up a comb-line filter. Electrodes 31, 33 having ends connected to the ground electrode 70 and other ends spaced a certain distance from the open ends of the resonant elements 21, 23 are disposed on the dielectric layer 14 in confronting relationship to the respective open ends of the resonant elements 21, 23. An inductive coupling adjustment electrode 101 is disposed on the dielectric layer 14 intermediate between the resonant elements 21, 23, the inductive coupling adjustment electrode 101 having opposite ends connected to the ground electrode 70.

A coupling electrode 91 is disposed on the dielectric layer 15, which is placed on the dielectric layer 14, in overlapping relationship to portions of the resonant elements 21, 23 across the dielectric layer 15.

An inner-layer ground electrode 82 having an end connected to the ground electrode 70 is disposed on the dielectric layer 16, which is placed on the dielectric layer 15, in overlapping relationship to the open ends of the resonant elements 21, 23 across the dielectric layers 15, 16.

The ground electrode 70 is disposed on a surface of the dielectric layer 17, which is placed on the dielectric layer 16. The dielectric layers 11~17 are integrally stacked and then fired into a laminated assembly 500 (see FIG. 5).

Figure 5:
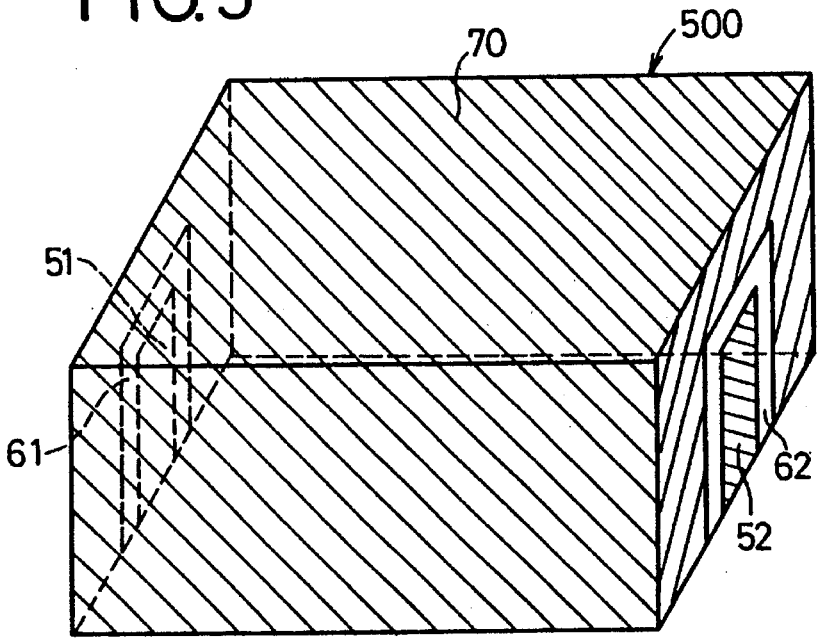
FIG. 5 is a perspective view of the layered stripline filter according to the present invention.

As shown in FIG. 5, the ground electrode 70 is disposed on upper and lower surfaces of the laminated assembly 500 and side surfaces thereof except input and output terminal areas 61, 62. The input terminal area 61, which is positioned on one side surface of the laminated assembly 500, has an input terminal 51 that is insulated from the ground electrode 70 and connected to the input electrode 41. The output terminal area 62, which is positioned on an opposite side surface of the laminated assembly 500, has an output terminal 52 that is insulated from the ground electrode 70 and connected to the output electrode 42.

Figure 6:
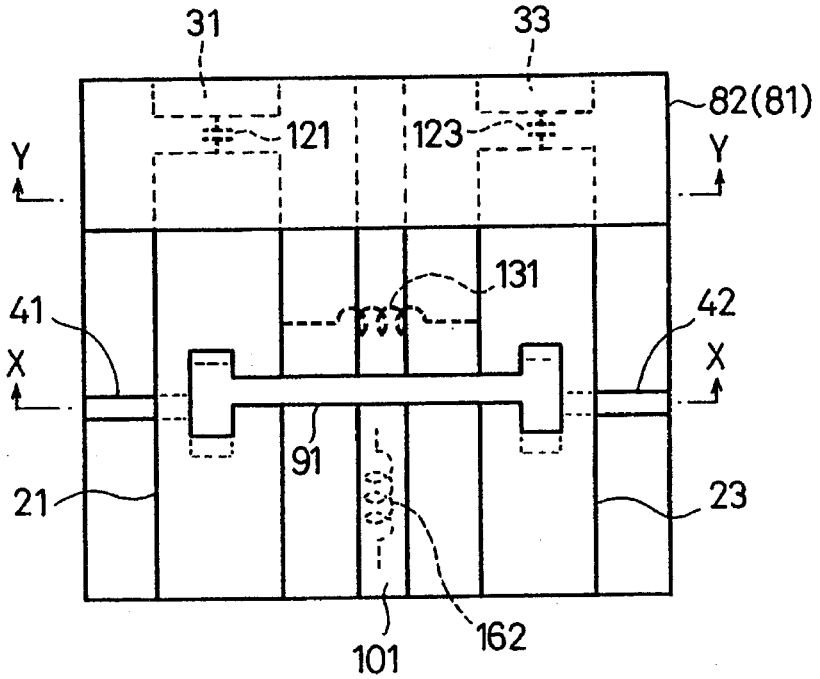
FIG. 6 is a plan view of a major portion of the layered stripline filter according to the present invention.
Figure 7:
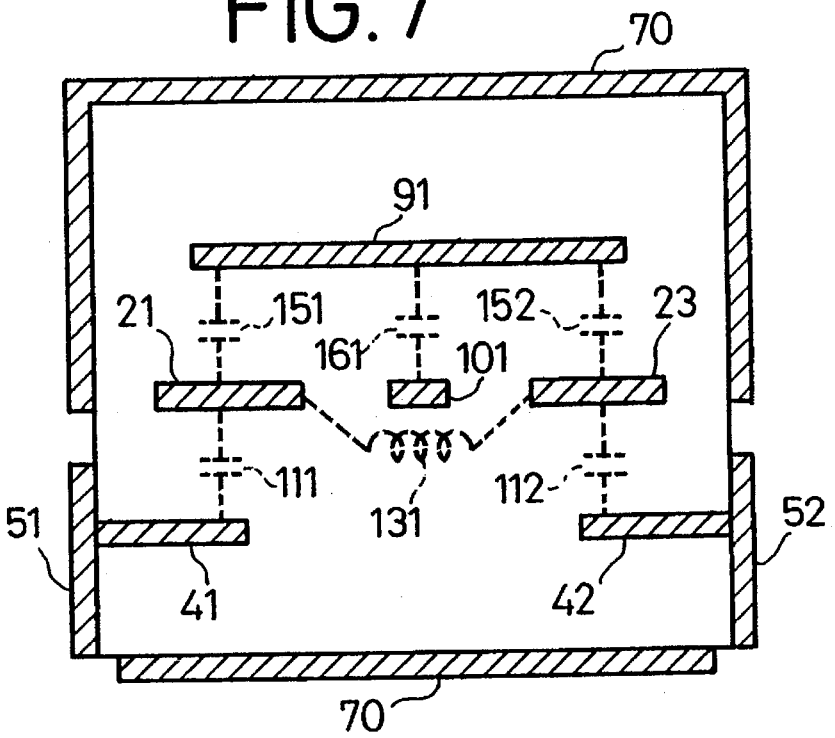
FIG. 7 is a cross-sectional view taken along line VII—VII of FIG. 6.
Figure 8:
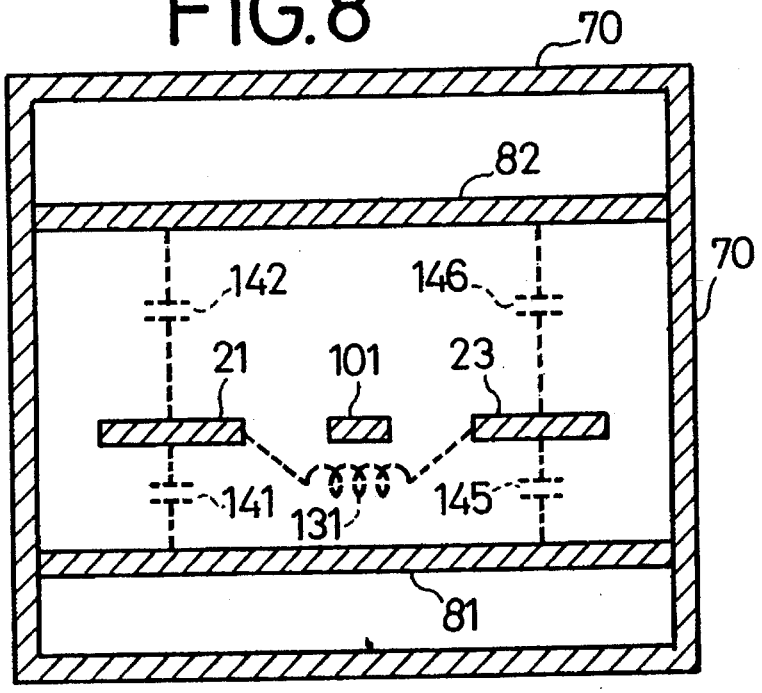
FIG. 8 is a cross-sectional view taken along line VIII—VIII of FIG. 6.

The resonant elements 21, 23, the electrodes 31, 33, the input electrode 41, the output electrode 42, the inner-layer ground electrodes 81, 82, the coupling electrode 91, and the inductive coupling adjustment electrode 101 are arranged in a spatial structure which is shown in FIGS. 6, 7, and 8.

The electrical lengths of the resonant elements 21, 23 are equal to or less than one-quarter wavelength, and the resonant elements 21, 23 are inductively coupled to each other. The inductive coupling between the resonant elements 21, 23 is equivalently represented by an inductance 131.

Capacitances 121, 123 are formed between the open ends of the resonant elements 21, 23 and the electrodes 31, 33, respectively.

A capacitance 111 is formed between the input electrode 41 and the resonant element 21, and a capacitance 112 is formed between the output electrode 42 and the resonant element 23.

A capacitance 151 is formed between the resonant element 21 and the coupling electrode 91, and a capacitance 152 is formed between the resonant element 23 and the coupling electrode 91.

The electrical length of the inductive coupling adjustment electrode 101 is equal to or less than one-half wavelength at the center frequency of the filter. Therefore, the inductive coupling adjustment electrode 101 has inductive electric characteristics. The inductive electric characteristics of the inductive coupling adjustment electrode 101 are represented by an inductance 162. A capacitance 161 is formed between the inductive coupling adjustment electrode 101 and the coupling electrode 91.

Capacitances 141, 142 are formed between the open end of the resonant element 21 and the inner-layer ground electrodes 81, 82, respectively, and capacitances 145, 146 are formed between the open end of the resonant element 23 and the inner-layer ground electrodes 81, 82, respectively.

Figure 9:
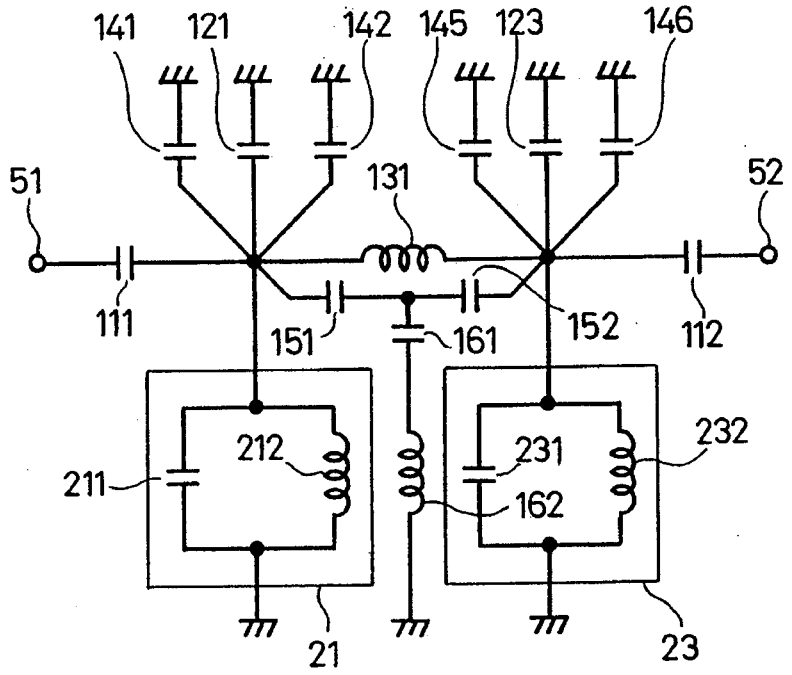
FIG. 9 is a circuit diagram of an equivalent electric circuit of the layered stripline filter according to the present invention.

The layered stripline filter thus constructed according to the present invention has an equivalent electric circuit as shown in FIG. 9 which exhibits bandpass filter characteristics.

Since the capacitances 151, 152 are connected parallel to the inductance 131 formed between the resonant elements 21, 23, the capacitances 151, 152 can suppress the inductive coupling that is formed between the resonant elements 21, 23 and represented by the inductance 131 in FIG. 9. Therefore, the degree of the inductive coupling between the resonant elements 21, 23 can be adjusted by adjusting the values of the capacitances 151, 152, for thereby making it possible to provide a filter having a desired bandwidth. The values of the capacitances 151, 152 can easily be adjusted by varying the overlapping areas of and the distance between the resonant element 21 and the coupling electrode 91 and the overlapping areas of and the distance between the resonant element 23 and the coupling electrode 91.

Because the coupling electrode 91 confronting both the resonant elements 21, 23 allows the capacitances 151, 152 formed between the resonant elements 21, 23 and the coupling electrode 91 to be connected parallel to the inductance 131 formed between the resonant elements 21, 23, a parallel resonant circuit composed of the capacitances 151, 152 and the inductance 131 is inserted between the resonant elements 21, 23. As the impedance of the parallel resonant circuit composed of the capacitances 151, 152 and the inductance 131 varies from an inductive nature to a capacitive nature across the parallel resonance, the coupling between the resonant elements 21, 23 may be made inductive or capacitive by adjusting the values of the capacitances 151, 152 formed between the resonant elements 21, 23 and the coupling electrode 91. If the coupling between the resonant elements 21, 23 is made inductive, then the filter has an attenuation peak in a frequency range higher than the passband because the parallel resonance is present in the higher frequency range. If the coupling between the resonant elements 21, 23 is made capacitive, then the filter has an attenuation peak in a frequency range lower than the passband because the parallel resonance is present in the lower frequency range. At any rate, the attenuation characteristics of the filter are improved.

Inasmuch as the inductive coupling adjustment electrode 101 whose opposite ends are connected to the ground electrode 70 is disposed intermediate between the resonant elements 21, 23, the inductive coupling adjustment electrode 101 weakens the inductive coupling between the resonant elements 21, 23.

In this arrangement, the coupling electrode 91 is disposed in overlapping relationship to portions of the resonant elements 21, 23, and the inductive coupling adjustment electrode 101 is disposed intermediate between the resonant elements 21, 23. Therefore, a parallel resonant circuit composed of the capacitances 151, 152 and the inductance 131 is inserted between the resonant elements 21, 23, making it possible to adjust the inductive coupling between the resonant elements 21, 23 with the capacitances 151, 152 and also to adjust the strength of the inductive coupling itself between the resonant elements 21, 23. As a result, the bandwidth of the filter and the position of the attenuation peak can individually be varied to achieve desired filter characteristics with ease.

Figure 10:
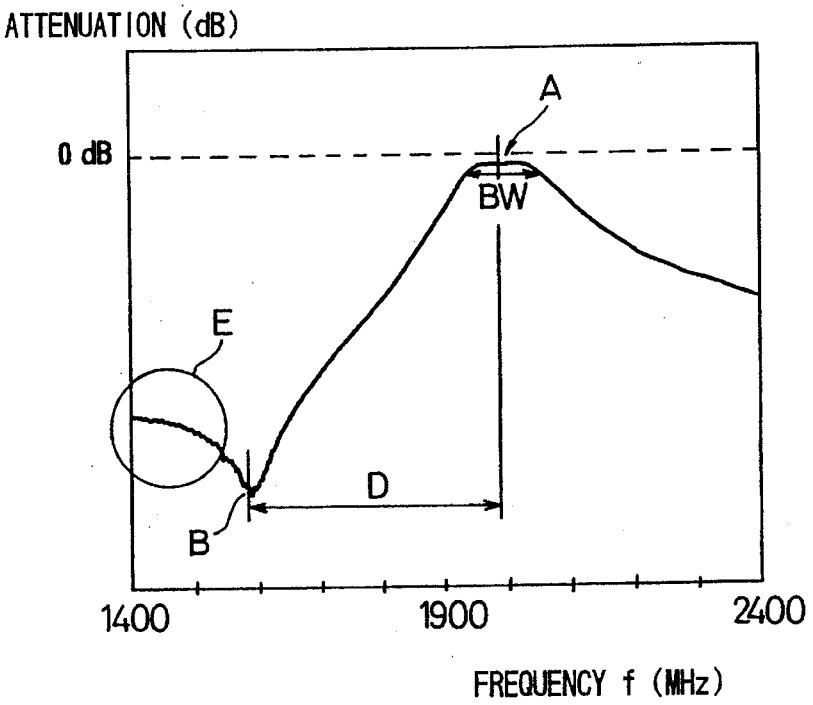
FIG. 10 is a diagram illustrative of frequency characteristics of the layered stripline filter according to the present invention.
Figure 11:
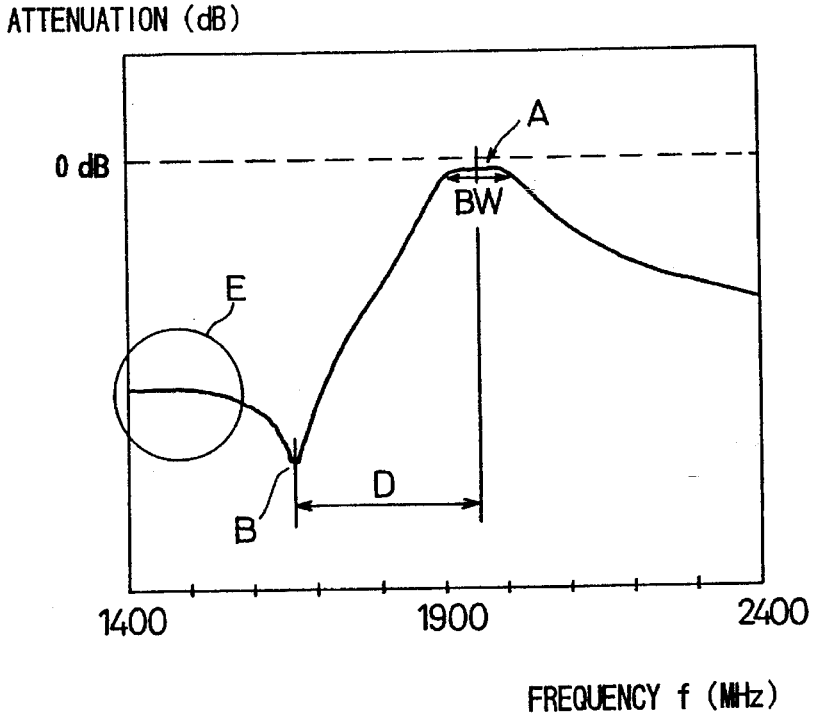
FIG. 11 is a diagram illustrative of frequency characteristics of a layered stripline filter with no inductive coupling adjustment electrode added.

FIG. 10 shows frequency characteristics of the layered stripline filter according to the present invention, and FIG. 11 shows frequency characteristics of a layered stripline filter with no inductive coupling adjustment electrode added. In these layered stripline filters, the bandwidth BW of their passbands A are substantially the same as each other. As shown in FIGS. 10 and 11, an attenuation peak B is present in a lower frequency range with the layered stripline filter according to the present invention which has the inductive coupling adjustment electrode 101 (see FIG. 10) than the layered stripline filter with no inductive coupling adjustment electrode added (see FIG. 11). Therefore, since the attenuation achieved by the layered stripline filter according to the present invention in a frequency range E lower than the attenuation peak B is greater, the attenuation characteristics of the layered stripline filter according to the present invention are improved.

The inductive coupling adjustment electrode 101 has its opposite ends grounded, and the electrical length thereof is greater than one-quarter wavelength and smaller than one-half wavelength at frequencies where the attenuation peak is to be produced. The inductive coupling adjustment electrode 101 has inductive electric characteristics represented by the inductance 162. Since the inductive coupling adjustment electrode 101 confronts a portion of the coupling electrode 91, the capacitance 161 is formed between the inductive coupling adjustment electrode 101 and the coupling electrode 91. As a consequence, a series resonant circuit composed of the capacitance 161 and the inductance 162 is added parallel to the filter circuit. An attenuation peak is produced in the passband at the resonant frequency of the series resonant circuit. Therefore, an attenuation peak can be produced at a desired frequency by adjusting the values of the capacitance 161 and the inductance 162 of the series resonant circuit to adjust the resonant frequency thereof. As a result, it is possible to improve spurious characteristics of the filter.

Figure 12:
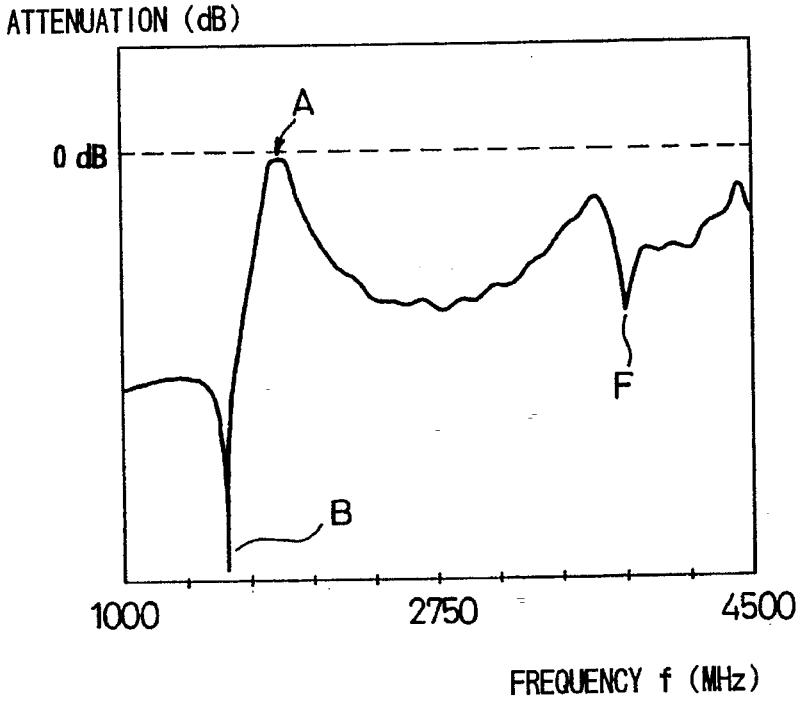
FIG. 12 is a diagram illustrative of spurious characteristics of the layered stripline filter according to the present invention.
Figure 13:
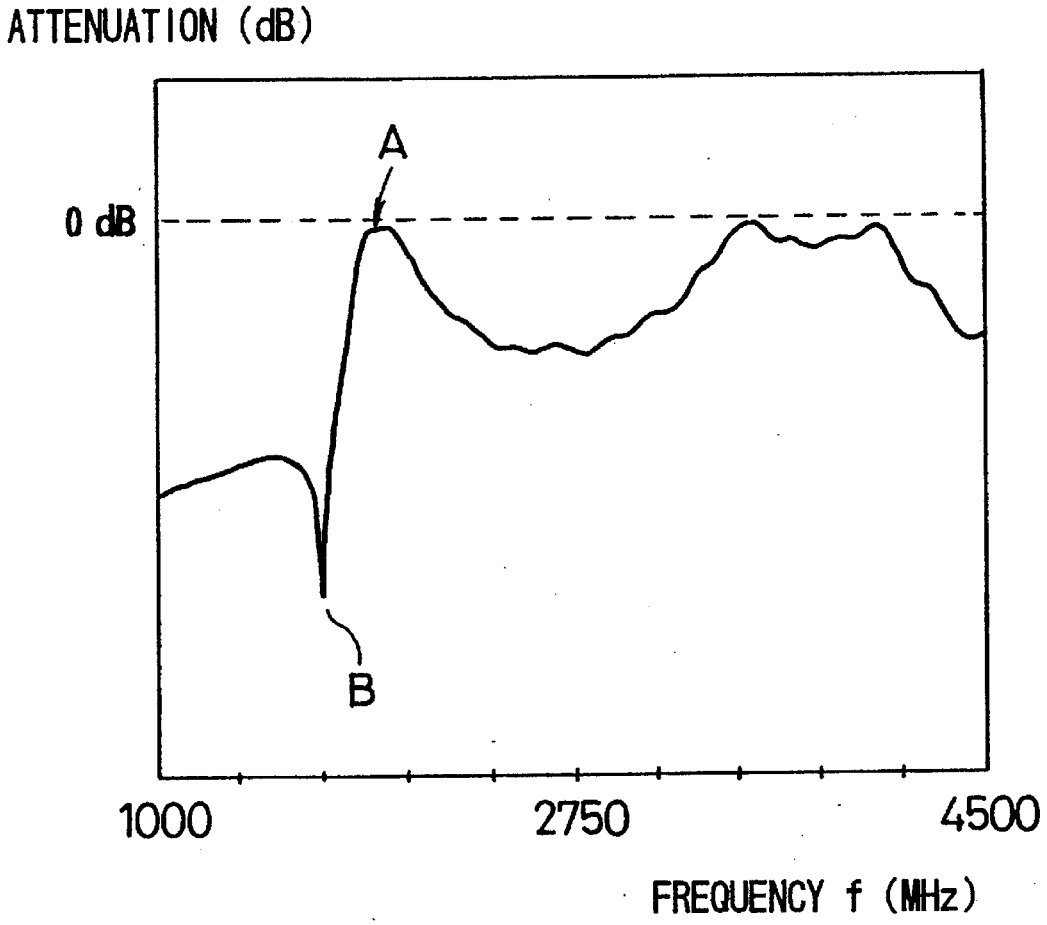
FIG. 13 is a diagram illustrative of spurious characteristics of a layered stripline filter with no inductive coupling adjustment electrode added.

FIG. 12 shows spurious characteristics of the layered stripline filter according to the present invention, and FIG. 13 shows spurious characteristics of a layered stripline filter with no inductive coupling adjustment electrode added. As shown in FIGS. 12 and 13, the layered stripline filter according to the present invention has improved spurious characteristics because of an attenuation peak F.

The inductance 162 of the series resonant circuit can easily be adjusted by varying the width of the inductive coupling adjustment electrode 101, and the capacitance 161 can easily be adjusted by varying the overlapping areas of and the distance between the inductive coupling adjustment electrode 101 and the coupling electrode 91.

Since the layered stripline filter according to the present invention has the inner-layer ground electrodes 81, 82 confronting the open ends of the resonant elements 21, 23, the capacitances 141, 142 formed between the open end of the resonant element 21 and the inner-layer ground electrodes 81, 82, respectively, is added to a capacitance 211 of a parallel resonant circuit which is equivalently converted from the resonant element 21, and the capacitances 145, 146 formed between the open end of the resonant element 23 and the inner-layer ground electrodes 81, 82, respectively, is added to a capacitance 231 of a parallel resonant circuit which is equivalently converted from the resonant element 23. Therefore, provided the resonant frequency is the same, the inductances 212, 232 of the parallel resonant circuits may be small, with the result that the lengths of the resonant elements 21, 22 may be reduced, and hence the entire length of the layered stripline filter may also be reduced.

If the confronting areas of the inner-layer ground electrodes 81, 82 and the resonant elements 21, 23 are increased to reduce the size of the layered stripline filter, then the resonant elements 21, 23 will be inductively coupled more strongly to each other, making the filter passband too wide. According to the present invention, however, since the coupling electrode 91 is disposed in confronting relationship to both the resonant elements 21, 23, the capacitances 151, 152 formed between the coupling electrode 91 and the resonant elements 21, 23 are effective to suppress the inductive coupling formed between the resonant elements 21, 23, and also since the inductive coupling adjustment electrode 101 is disposed intermediate between the resonant elements 21, 23, the strength of the inductive coupling between the resonant elements 21, 23 can be reduced. The layered stripline filter can thus have a desired bandwidth.

A process of manufacturing the layered stripline filter according to the present invention will be described below.

Inasmuch as the resonant elements 21, 23, the electrodes 31, 33, the input electrode 41, the output electrode 42, the inner-layer ground electrodes 81, 82, the coupling electrode 91, and the inductive coupling adjustment electrode 101 are fully contained in a dielectric body of the dielectric assembly 500, it is preferable that the resonant elements 21, 23, the electrodes 31, 33, the input electrode 41, the output electrode 42, the inner-layer ground electrodes 81, 82, the coupling electrode 91, and the inductive coupling adjustment electrode 101 be made of a material having a low specific resistance with a low loss, preferably, a conductive material composed of Ag or Cu having a low electric resistance.

The dielectric body should preferably be made of a ceramic dielectric material which allows the dielectric body to be small in size due to its high reliability and large dielectric constant $\epsilon_r$.

For manufacturing the layered stripline filter, it is preferable to coat a conductive paste on each of formed bodies of ceramic powder to form an electrode pattern thereon, then stacking the formed bodies, firing the assembly to make it dense, so that the conductive members are laminated and integrally joined to the ceramic dielectric material.

If a conductive material composed of Ag or Cu is used, then since these conductive materials have low melting points and should not be fired at the same time that the dielectric material is fired, it is necessary to employ a dielectric material which can be fired at a temperature lower than the melting points (1100° C. or lower) of these conductive materials. Because of the nature of the layered stripline filter for use as a microwave filter, it is desirable to employ such a dielectric material that the temperature characteristic (temperature coefficient) of the resonant frequency of the parallel resonant circuits is ±50 ppm/°C. or below. Such a dielectric material may be a glass material such as a mixture of cordierite glass powder, $TiO_2$ powder, and $Nd_2Ti_2O_7$ powder, a $BaO—TiO_2—Re_2O_3—Bi_2O_3$composition (Re: rare earth component) with a slight amount of glass forming component or glass powder added thereto, or dielectric magnetic composition powder of barium oxide-titanium oxide-neodymium oxide with a slight amount of glass powder added thereto.

According to an example, 73 wt % of glass powder having a composition of MgO: 18 wt % —$Al_2O_3$: 37 wt % —$SiO_2$: 37 wt % —$B_2O_8$: 5 wt % —$TiO_2$: 3 wt %, 17 wt % of commercially available $TiO_2$ powder, and 10 wt % of $Nd_2Ti_2O_7$ powder were sufficiently mixed together, thus producing a mixed powder. The $Nd_2Ti_2O_7$ powder was prepared by temporarily firing $Nd_2O_3$ powder and $TiO_2$ powder and then crushing the fired mass. Then, to the mixed powder were added an acrylic organic binder, a plasticizer, a toluene-based solvent, and an alcohol-based solvent. They were sufficiently mixed into a slurry by flint pebbles of alumina. Then, a green sheet having a thickness ranging from 0.2 mm to 0.5 mm was produced from the slurry using a doctor blade.

Conductive patterns shown in FIG. 4 were printed on respective green sheets using a silver paste as a conductive paste, and green sheets necessary to adjust the thicknesses of the green sheets with the printed conductive patterns were stacked into the structure shown in FIG. 4. Thereafter, the stack was fired at 900° C., thereby manufacturing the laminated assembly 500.

Then, a ground electrode 70 composed of a silver electrode as shown in FIG. 5 was printed on the upper and lower surfaces of the laminated assembly 500 and the side surfaces thereof except the input and output terminal areas 61, 62. Silver electrodes insulated from the ground electrode 70 and connected respectively to the input and output electrodes 41, 42 were printed as input and output terminals 51, 52 within the respective input and output terminal areas 61, 62, and then baked at 850° C. In this manner, the layered stripline filter according to the present invention was manufactured.

According to the present invention, first and second resonant elements which are short-circuited at one side are positioned adjacent to each other, and a first electrode is disposed in confronting relationship to portions of the first and second resonant elements. Capacitances are connected parallel to an inductive coupling formed between the first and second resonant elements. The capacitances are effective in suppressing the inductive coupling formed between the first and second resonant elements. Therefore, there is obtained a filter having a desired bandwidth.

Since the first electrode is disposed in confronting relationship to the first and second resonant elements, a parallel resonant circuit composed of the capacitances and an inductance is inserted between the first and second resonant elements that are adjacent to each other. As a result, an attenuation peak is formed in a high-or low-frequency range side of the passband of the filter, thereby improving the attenuation characteristics of the filter.

A second electrode is disposed in a dielectric layer between the first and second resonant elements. Therefore, a parallel resonant circuit composed of capacitances and an inductance is inserted between the first and second resonant elements. The inductive coupling between the first and second resonant elements can be adjusted by the capacitances, and the strength of the inductive coupling itself between the first and second resonant elements can also be adjusted. As a consequence, the bandwidth of the filter and the position of the attenuation peak can individually be varied to achieve desired filter characteristics with ease. With the position of the attenuation peak being selected so as to be spaced apart from the passband of the filter, the attenuation in a range which is opposite to the passband across the attenuation peak can be increased, thereby further improving the attenuation characteristics of the filter.

The inductive coupling between the first and second resonant elements can be reduced particularly effectively by short-circuiting the opposite ends of the second electrode to ground.

The spurious characteristics of the filter can effectively be improved by connecting the opposite ends of the second electrode disposed between the first and second resonant elements to ground, selecting the electrical length of the second electrode to be equal to or less than one-half wavelength, and positioning the second electrode in the dielectric layer in confronting relationship to a portion of the first electrode which confronts both portions of the first and second resonant elements.

Although a certain preferred embodiment of the present invention has been shown and described in detail, it should be understood that various changes and modifications may be made therein without departing from the scope of the appended claims.

What is claimed is:

1. A layered stripline filter comprising:

a first ground electrode;

a second ground electrode;

a dielectric layer disposed between said first ground electrode and said second ground electrode;

a first resonant element short-circuited at one side and disposed in said dielectric layer;

a second resonant element short-circuited at one side and disposed adjacent to said first resonant element in said dielectric layer;

a first electrode disposed in said dielectric layer in direct confronting relationship to a portion of said first resonant element and in direct confronting relationship to a portion of said second resonant element; and a second electrode disposed in said dielectric layer between said first resonant element and said second resonant element, said second electrode being separated from said first electrode with a portion of said dielectric layer interposed between said first electrode and said second electrode, and said second electrode having opposite ends short-circuited to ground.

2. A layered stripline filter according to claim 1, wherein said second electrode is disposed in said dielectric layer in confronting relationship to a portion of said first electrode.

* * * * *